US010405680B2

(12) United States Patent
Mithal

(10) Patent No.: US 10,405,680 B2
(45) Date of Patent: Sep. 10, 2019

(54) LID FEATURING IMPROVED SPLASH AND SPILL RESISTANCE AND EASE OF FLOW

(71) Applicant: Waddington North America, Inc., Chelmsford, MA (US)

(72) Inventor: Ashish K. Mithal, Chelmsford, MA (US)

(73) Assignee: Waddington North America, Inc., Chelmsford, MA (US)

( * ) Notice: Subject to any disclaimer, the term of this patent is extended or adjusted under 35 U.S.C. 154(b) by 169 days.

(21) Appl. No.: 14/995,290

(22) Filed: Jan. 14, 2016

(65) Prior Publication Data

US 2016/0198876 A1 Jul. 14, 2016

Related U.S. Application Data

(60) Provisional application No. 62/103,110, filed on Jan. 14, 2015.

(51) Int. Cl.
*A47G 19/22* (2006.01)
*B65D 43/02* (2006.01)

(52) U.S. Cl.
CPC ..... *A47G 19/2211* (2013.01); *B65D 43/0208* (2013.01); *B65D 2543/00046* (2013.01);
(Continued)

(58) Field of Classification Search
CPC ..... B65D 2543/00046; B65D 47/06; B65D 47/043; B65D 2547/063; B65D 43/0212;
(Continued)

(56) References Cited

U.S. PATENT DOCUMENTS 236,266 A 1/1881 Shirley
622,564 A 4/1899 Tebbetts
(Continued)

FOREIGN PATENT DOCUMENTS

JP 2010274965 A 12/2010
JP 2012176800 A 9/2012

OTHER PUBLICATIONS

PCT Search Report dated Apr. 1, 2016 of Patent Application No. PCT/US2016/013181, filed Jan. 13, 2016.
(Continued)

*Primary Examiner* — Shawn M Braden
(74) *Attorney, Agent, or Firm* — Maine Cernota & Rardin

(57) ABSTRACT

A lid for a drinking cup enables drinking while inhibiting splashing and spilling. The lid features a drinking spout having an outer wall, an inner wall and a top wall. A dispensing well formed in the spout includes a bottom wall, two end walls, and at least two opposed sidewall openings. Nearly all vertical beverage splashes impinge upon the underside of the bottom wall, while the opposed openings allow splashes entering the dispensing well to be drained through the opposite opening. A plurality of vent holes can be provided to allow air to enter the cup as beverage is consumed. Vent holes near the dispensing well can be blocked during drinking, when the cup is full and the beverage is hot, but unblocked as the beverage cools and is consumed. Interior baffle walls around the dispensing well can inhibit swirling or laterally-splashing beverage from entering the dispensing well.

34 Claims, 13 Drawing Sheets

(52) U.S. Cl.
CPC ..... *B65D 2543/0074* (2013.01); *B65D 2543/00092* (2013.01); *B65D 2543/00296* (2013.01); *B65D 2543/00416* (2013.01); *B65D 2543/00518* (2013.01); *B65D 2543/00537* (2013.01); *B65D 2543/00638* (2013.01); *B65D 2543/00685* (2013.01); *B65D 2543/00796* (2013.01)

(58) Field of Classification Search
CPC ..... B65D 2543/00; A47G 19/2272; B29C 65/02; B29C 65/08; B29C 65/48; B29C 65/565; B29C 65/606; B29C 66/1122; B29C 66/5346; B29C 66/61; B29L 2031/565
USPC ..... 220/713
See application file for complete search history.

(56) References Cited

U.S. PATENT DOCUMENTS

| | | | |
|---|---|---|---|
| 1,034,636 | A | 8/1912 | McNair |
| D43,852 | S | 4/1913 | Sanford |
| D52,727 | S | 12/1918 | Beiswanger |
| 1,441,010 | A | 1/1923 | McGuire |
| D69,040 | S | 12/1925 | Loomis |
| D69,929 | S | 4/1926 | Zimmerman |
| 1,629,358 | A | 5/1927 | Padgett |
| D99,555 | S | 5/1936 | Smith |
| D124,290 | S | 12/1940 | Chaplin |
| 2,259,856 | A | 10/1941 | Moore |
| D164,407 | S | 9/1951 | Cowan |
| D174,832 | S | 5/1955 | Nowak |
| 3,047,179 | A | 7/1962 | Madej |
| D195,699 | S | 7/1963 | Bostrom |
| 3,101,857 | A | 8/1963 | Freedman |
| 3,546,752 | A | 12/1970 | Sargent |
| 3,589,551 | A | 6/1971 | Haggbom |
| 3,655,089 | A | 4/1972 | Tower |
| 3,688,942 | A | 9/1972 | Mitchell et al. |
| 3,693,847 | A | 9/1972 | Gibson |
| 3,707,240 | A | 12/1972 | Wilson |
| 3,889,842 | A | 6/1975 | Bennett |
| 4,049,187 | A | 9/1977 | Florian |
| 4,190,173 | A | 2/1980 | Mason |
| 4,241,855 | A | 12/1980 | Yoshioka |
| 4,322,014 | A | 3/1982 | Philip |
| 4,331,255 | A | 5/1982 | Fournier |
| 4,394,928 | A | 7/1983 | Philip |
| 4,494,672 | A | 1/1985 | Pearson |
| 4,503,992 | A | 3/1985 | Sitko et al. |
| 4,589,569 | A | 5/1986 | Clements |
| 4,615,459 | A | 10/1986 | Clements |
| 4,619,372 | A | 10/1986 | McFarland |
| 4,620,665 | A | 11/1986 | McSherry |
| D287,207 | S | 12/1986 | Daenen et al. |
| 4,684,024 | A | 8/1987 | Ebrahim et al. |
| 4,687,117 | A | 8/1987 | Terauds |
| 4,721,210 | A | 1/1988 | Lawrence et al. |
| 4,753,365 | A | 6/1988 | Seppala |
| 4,782,975 | A | 11/1988 | Coy |
| 4,805,797 | A | 2/1989 | Natori |
| 4,874,083 | A | 10/1989 | Antoni et al. |
| 4,899,902 | A | 2/1990 | Demars |
| 4,949,880 | A | 8/1990 | Bradley |
| 4,986,438 | A | 1/1991 | Borst |
| 5,050,758 | A | 9/1991 | Freeman et al. |
| 5,054,640 | A | 10/1991 | Tucker |
| 5,076,333 | A | 12/1991 | Law |
| 5,125,525 | A | 6/1992 | Tucker |
| 5,143,248 | A | 9/1992 | Sawatsky |
| 5,203,467 | A | 4/1993 | Tucker |
| 5,203,490 | A | 4/1993 | Roe |
| 5,205,473 | A | 4/1993 | Coffin, Sr. |
| 5,222,656 | A | 6/1993 | Carlson |
| 5,240,132 | A | 8/1993 | Tucker |
| 5,253,780 | A | 10/1993 | Adado |
| 5,253,781 | A | 10/1993 | Van Melle et al. |
| D344,210 | S | 2/1994 | Cousisn et al. |
| D345,912 | S | 4/1994 | Krupa |
| D346,554 | S | 5/1994 | Krupa |
| 5,348,181 | A | 9/1994 | Smith et al. |
| D352,000 | S | 11/1994 | Hansen et al. |
| 5,363,978 | A | 11/1994 | Molo |
| D353,519 | S | 12/1994 | Wolfenden |
| 5,392,949 | A | 2/1995 | McKenna |
| 5,398,843 | A | 3/1995 | Warden |
| D358,091 | S | 5/1995 | Warburton |
| 5,425,497 | A | 6/1995 | Sorensen |
| D361,696 | S | 8/1995 | Wolfenden |
| 5,441,166 | A | 8/1995 | Lucas et al. |
| D364,090 | S | 11/1995 | Krupa |
| 5,490,609 | A | 2/1996 | Lane et al. |
| 5,509,582 | A | 4/1996 | Robbins, III |
| 5,538,154 | A | 7/1996 | Von Holdt |
| 5,538,157 | A | 7/1996 | Proshan |
| 5,540,350 | A | 7/1996 | Lansky |
| 5,542,670 | A | 8/1996 | Morano |
| 5,553,701 | A | 9/1996 | Jarecki et al. |
| D374,820 | S | 10/1996 | Knoss et al. |
| 5,579,949 | A | 12/1996 | Dykes et al. |
| 5,607,076 | A | 3/1997 | Anthony |
| 5,613,619 | A | 3/1997 | Van Melle |
| 5,613,720 | A | 3/1997 | Shaddy |
| 5,624,053 | A | 4/1997 | Freek et al. |
| 5,678,720 | A | 10/1997 | Van Melle |
| 5,695,086 | A | 12/1997 | Viola |
| D391,479 | S | 3/1998 | Poitras |
| D391,850 | S | 3/1998 | Krupa et al. |
| 5,752,646 | A | 5/1998 | Sandstrom |
| 5,765,716 | A | 6/1998 | Cai et al. |
| 5,772,111 | A | 6/1998 | Kirsch |
| 5,820,016 | A | 10/1998 | Stropkay |
| 5,839,601 | A | 11/1998 | Van Melle |
| 5,894,952 | A | 4/1999 | Mendenhall et al. |
| D411,714 | S | 6/1999 | Wilson et al. |
| D413,487 | S | 9/1999 | Vitali |
| D414,413 | S | 9/1999 | Brown |
| 5,947,323 | A | 9/1999 | Freek et al. |
| D415,024 | S | 10/1999 | McCann |
| D415,025 | S | 10/1999 | McCann |
| 5,960,987 | A | 10/1999 | Solland et al. |
| D416,445 | S | 11/1999 | Henry |
| 5,979,689 | A | 11/1999 | Lansky |
| 5,979,697 | A | 11/1999 | Kim |
| D420,285 | S | 2/2000 | Sagan et al. |
| D420,854 | S | 2/2000 | Michaeli |
| D421,202 | S | 2/2000 | Demers |
| 6,089,397 | A | 7/2000 | Van Melle |
| D435,197 | S | 12/2000 | Wellner |
| 6,176,390 | B1 | 1/2001 | Kemp |
| 6,199,711 | B1 | 3/2001 | Lansky |
| 6,216,904 | B1 | 4/2001 | Cagan |
| 6,260,727 | B1 | 7/2001 | Durdon |
| 6,296,141 | B1 | 10/2001 | Lukacevic |
| 6,305,571 | B1 | 10/2001 | Chu |
| D450,537 | S | 11/2001 | Hayes |
| D450,538 | S | 11/2001 | Benson |
| 6,311,863 | B1 | 11/2001 | Fleming |
| 6,318,584 | B1 | 11/2001 | Milan |
| 6,325,236 | B1 | 12/2001 | Wong |
| D457,037 | S | 5/2002 | Haynes |
| 6,419,105 | B1 | 7/2002 | Bruce et al. |
| D461,678 | S | 8/2002 | Haynes |
| 6,431,390 | B1 | 8/2002 | Waller |
| 6,488,173 | B2 | 12/2002 | Milan |
| 6,533,139 | B2 | 3/2003 | Lukacevic |
| 6,578,726 | B1 | 6/2003 | Schaefer |
| 6,612,456 | B1 | 9/2003 | Hundley et al. |
| 6,644,490 | B2 | 11/2003 | Clarke |
| 6,679,397 | B2 | 1/2004 | Smith et al. |
| 6,702,145 | B2 | 3/2004 | Malcolm |
| 6,732,875 | B2 | 5/2004 | Smith et al. |
| 6,755,318 | B2 | 6/2004 | Burke |

(56) References Cited

U.S. PATENT DOCUMENTS

| | | | | |
|---|---|---|---|---|
| 6,811,049 | B2 | 11/2004 | Lukacevic | |
| 6,874,649 | B2 | 4/2005 | Clarke et al. | |
| 6,889,859 | B1 | 5/2005 | Leon | |
| 6,889,860 | B2 | 5/2005 | Mazzarolo | |
| 6,923,337 | B2 | 8/2005 | Hession et al. | |
| 6,929,143 | B2 | 8/2005 | Mazzarolo | |
| 6,991,128 | B1 * | 1/2006 | Russo | B65D 43/0212 220/713 |
| 7,032,773 | B2 | 4/2006 | Dees et al. | |
| 7,063,224 | B2 | 6/2006 | Clarke et al. | |
| 7,086,549 | B2 | 8/2006 | Kosmyna et al. | |
| 7,100,790 | B2 | 9/2006 | Dark | |
| 7,111,749 | B1 | 9/2006 | Akers | |
| 7,131,551 | B2 | 11/2006 | Smith | |
| 7,134,566 | B2 | 11/2006 | Smith et al. | |
| 7,134,570 | B1 | 11/2006 | Heath et al. | |
| 7,156,251 | B2 | 1/2007 | Smith et al. | |
| 7,178,685 | B2 | 2/2007 | Hidalgo et al. | |
| 7,246,715 | B2 | 7/2007 | Smith et al. | |
| 7,757,886 | B2 | 7/2010 | Ho | |
| 7,959,029 | B2 | 6/2011 | Whitaker et al. | |
| 7,980,432 | B2 | 7/2011 | Brannon et al. | |
| 8,052,003 | B2 | 11/2011 | Burns | |
| D659,465 | S | 5/2012 | Burns | |
| D660,077 | S | 5/2012 | Burns | |
| D673,809 | S | 1/2013 | Burns | |
| 2002/0011494 | A1 | 1/2002 | Lukacevic | |
| 2002/0038803 | A1 | 4/2002 | Malcolm | |
| 2002/0096530 | A1 | 7/2002 | Waller | |
| 2003/0089713 | A1 | 5/2003 | Belt et al. | |
| 2004/0232154 | A1 | 11/2004 | Smith et al. | |
| 2005/0072787 | A1 | 4/2005 | Morris | |
| 2005/0087539 | A1 | 4/2005 | Waller | |
| 2005/0098581 | A1 | 5/2005 | Long et al. | |
| 2005/0173443 | A1 | 8/2005 | Crudgington, Jr. | |
| 2005/0205587 | A1 | 9/2005 | Sampson et al. | |
| 2005/0267425 | A1 | 12/2005 | Castora et al. | |
| 2006/0006184 | A1 | 1/2006 | Bohman et al. | |
| 2006/0096983 | A1 | 5/2006 | Patterson | |
| 2006/0124645 | A1 | 6/2006 | Peitersen | |
| 2006/0249476 | A1 | 11/2006 | Albers et al. | |
| 2007/0012710 | A1 | 1/2007 | Vovan | |
| 2007/0131691 | A1 | 6/2007 | Evans | |
| 2008/0011762 | A1 | 1/2008 | Boone | |
| 2008/0054027 | A1 | 3/2008 | Skillin et al. | |
| 2008/0156802 | A1 | 7/2008 | Yauk et al. | |
| 2008/0156817 | A1 | 7/2008 | Roseblade et al. | |
| 2009/0050641 | A1 | 2/2009 | Ivey | |
| 2009/0065518 | A1 | 3/2009 | Carnevali | |
| 2009/0108006 | A1 | 4/2009 | Milan | |
| 2009/0294460 | A1 | 12/2009 | Hovsepian et al. | |
| 2010/0065588 | A1 | 3/2010 | Brannon et al. | |
| 2010/0108701 | A1 | 5/2010 | Lee et al. | |
| 2010/0133272 | A1 * | 6/2010 | Whitaker | B65D 43/0212 220/254.1 |
| 2012/0199584 | A1 | 8/2012 | Pensak | |
| 2012/0312827 | A1 | 12/2012 | Zuares | |
| 2014/0299614 | A1 | 10/2014 | Mithal | |

OTHER PUBLICATIONS

PCT Search Report dated Mar. 29, 2016 of Patent Application No. PCT/US2016/013319 filed Jan. 14, 2016.

PCT Search Report, PCT Application No. PCT/US2006/040392, dated May 8, 2007, 3 pages.

PCT Search Report, PCT Application No. PCT/US2009/068265, dated Feb. 4, 2010, 1 page.

Cardinal Glassware, Arcoroc, Cardinal International, 30 Corporate Drive, Wayne, NJ 07470 (6 pages) pp. 84 and 85 of Catalog.

PCT Search Report & Written Opinion, PCT Application No. PCT/US2014/032925, dated Aug. 5, 2014, 12 pages.

* cited by examiner

LID FEATURING IMPROVED SPLASH AND SPILL RESISTANCE AND EASE OF FLOW

RELATED APPLICATIONS

This application claims the benefit of U.S. Provisional Application No. 62/103,110, filed Jan. 14, 2015, which is herein incorporated by reference in its entirety for all purposes.

FIELD OF THE INVENTION

This invention relates to lids for use with drinking vessels, and more particularly to lids featuring improved splash and spill resistance and ease of flow through drinking cups containing a consumable beverage.

BACKGROUND OF THE INVENTION

Drinking cups, coffee cups, and other types of drinking vessels and cups from which a beverage can be consumed, are frequently used in combination with a cooperating lid adapted for attachment to the cup rim. Some lid designs require removal of the lid from the drinking vessel for consuming the beverage contained therein. However, most commercial drinking cup lids today feature a drink-through opening which allows a user to consume the beverage contained in the drinking vessel without removing the lid therefrom. Note that herein the terms "cup" and "vessel" are used generically to refer to all types of vessels, cups, and containers from which a beverage may be consumed.

Commonly used coffee cup lids typically feature a drink-through opening proximate to the perimeter of the lid in the form of a small, unobstructed aperture or hole within the lid that allows a person to drink coffee or another beverage without removing the lid from the cup. In addition, at least one separate vent hole is often included in a disposable lid so as to allow air to enter the cup and equalize the pressure inside the cup as the beverage is consumed.

While providing a drink-through opening in a coffee cup lid facilitates consumption of the beverage without separating the lid from the drinking vessel, it also creates a risk that beverage could be inadvertently splashed or spilled out through the opening if the cup is inadvertently tipped or jostled, or is subjected to sudden acceleration or deceleration. These situations are often encountered when the cup or other drinking vessel is being transported, whether by hand, within a cup holder in a moving vehicle, or while walking, climbing stairs, or traveling in an elevator or escalator.

Inadvertent spilling and splashing can create dangerous situations when a user is driving or moving. With today's busy lifestyle, consumption of beverages on-the-go has become commonplace, and inadvertent spilling and splashing of a beverage can be particularly irksome and embarrassing for a user when en route to work or to a professional and/or social engagement. The term "spilling" as generally used herein refers to inadvertent flowing of a beverage out of a cup or drinking vessel, and the term "splashing" as generally used herein refers to the inadvertent ejection or scattering from a cup of beverage droplets or modest quantities of beverage that become airborne due to sudden and/or rapid movement or halting of the drinking vessel.

It will be appreciated by those skilled in the art that lids for use with cold beverages such as sodas often include holes that fit snuggly around drinking straws, whereby the length of the straw effectively prevents splashing and spilling.

However, straws are typically not practical, or at least are not preferred, when consuming a hot beverage such as tea, coffee, or hot chocolate.

Lids designed for use with hot beverages sometimes include small holes or flaps near their rims that can be opened for drinking. However, turbulence or "sloshing" of a beverage when the cup has substantial quantities of beverage therein can easily lead to spilling of some liquid out from the hole, and jostling of the cup can cause liquid to splash or spill through such a hole or flap.

A drainage well is sometimes provided in a disposable lid so that small amounts of liquid that do spill or splash inadvertently from the drinking orifice (or through a vent hole) will pool in a designated region of the lid and drain back into the cup. However, such drainage wells are typically shallow, and are only effective if the cup is maintained in a near-vertical orientation. In certain situations, additional jostling may even cause liquid to splash or spill out of the drainage well before it has drained back into the cup.

A drinking hole or orifice is sometimes placed at the top of a raised spout, so as to reduce the likelihood that liquid will spill or splash from the drinking hole. However, since the drinking hole is in the direct path of a beverage splash, liquid is still able to splash through the drinking hole if the cup is shaken or jostled with sufficient force, for example if the beverage is being consumed while traveling in a vehicle and the vehicle drives over a rough road, a speed bump, a pot hole, or some other uneven feature in the road (such as train tracks), or is forced to brake or maneuver suddenly.

Various types of lids for use with drinking cups that feature closable drinking orifices or spouts have been proposed in the art, and some of them are in commercial use. One such lid construction includes a rotatable second piece that can seal the drinking orifice, so that the drinking orifice can be opened and closed by sliding the rotatable second piece to alternate between open and closed positions. Another lid construction includes a connected or tethered cap or plug that can be used to seal the drinking orifice. Still another approach for preventing spills and splashes from the drinking orifice involves placing an adhesive sticker on the drinking orifice (see U.S. Pat. No. 7,111,749).

Yet another approach involves using a drinking cup with a traditional lid having a drinking orifice, and equipping the cup-lid combination with a separate plug device having a handle end for grasping and a narrow elongated end that is inserted in the drinking cup through the drinking orifice in the lid for temporarily sealing the drinking orifice during transportation or until the user is ready to consume the beverage. See for example U.S. Pat. Nos. 8,052,003, D660,077, D659,465 and D673,809). Once the user is ready to consume the beverage, the plug device is removed by pulling on its exposed handle-end and simply discarded.

These approaches, however, only provide protection from spilling and splashing when the drinking orifice is closed or blocked, and do not naturally inhibit spilling and splashing when open. Furthermore, when the drinking orifice is closed or blocked it also prevents a user from consuming the beverage. It will be appreciated by those of ordinary skill that these lids tend to be multi-piece constructions, and may be generally more expensive to produce than a one-piece construction lid and may require an assembly step after forming or molding the lid. In addition, it is too cumbersome and burdensome for a user to repeatedly plug and unplug the drinking orifice manually each time a portion of beverage is to be consumed. Accordingly, once a user has unplugged the drink-through opening, the lid essentially tends to function as an open-spout lid and does not provide splash protection when resting unplugged or during use or consumption of the beverage.

Another approach is to provide a two-piece or multi-piece lid assembly comprising a separate insert that can be placed either on a cup or underneath a lid, wherein the separate insert has fluid passages that are not aligned with the drinking and vent openings in the lid, thereby preventing straight-line travel by splashed, airborne droplets from the cup interior through a lid opening, and forcing the beverage to flow through a convoluted path before exiting through the lid (see for example U.S. Pat. Nos. 5,540,350, 5,979,689, 6,305,571, 6,318,584, 6,533,139, 6,811,049 and 7,959,029).

While a two-piece lid assembly may provide good splash resistance, it presents some practical hurdles. If the insert and the lid are required to be installed by a consumer, then it may be inconvenient and cumbersome for the consumer. Also, separate inserts can become dislodged, or can shift in position, and can therefore be unreliable. This is true even if the insert is loosely attached to the lid or separately attached to the rim of the cup. In addition, this approach necessarily raises the manufacturing cost of the lid, since the manufacturing involves providing and installing a separate insert within a lid as part of a secondary operation. In addition, since an insert can become dislodged or shift in position, reliable assembly may also require joining the insert and the lid via fastening, gluing, and/or bonding operations, further increasing the manufacturing cost of the lid-assembly.

A one-piece splash and spill resistant lid is described in US Patent Publication 20100133272 to Whitaker et al. (Whitaker '272) and assigned to the assignee of the present invention. Whitaker '272 describes a variety of lid constructions wherein the spout openings have been manipulated to have constricted dimensions which can be disposed in the spout well. Another lid construction that inhibits splashing and spilling is described in U.S. patent application Ser. No. 14/245,116 (Mithal '116) filed on Apr. 4, 2014 and is assigned to the assignee of the present invention.

It has been found that while constricting the openings provides some degree of splash resistance, a user may still be exposed to splashing hazards from hot beverages. A disadvantage of the disclosed lid constructions in Whitaker '272 and Mithal '116 is that the improved splash and spill resistance is obtained by constricting the drinking orifice. Although, constricting the drinking orifice improves the splash performance through the drinking orifice, it detrimentally affects beverage flow through the drinking orifice. It has been observed by those skilled in the art that if consumers experience discomfort or have to exert themselves in drinking from a constricted drinking orifice, they may simply discard the lid due to the difficulty of drinking from it due to poor flow through the constricted orifice.

What is needed, therefore, is an improved lid for use with a drinking cup that is splash and spill resistant but still provides adequate beverage flow through the drinking orifice, thereby enabling the drinking of a beverage without requiring separation of the lid from the drinking cup, while also inherently inhibiting, or at least minimizing, inadvertent spilling and splashing of the beverage from the cup, without requiring deployment of manual plugs or blocking devices or secondary attachments. These and other needs, as shall hereinafter appear, are met by the device of the present invention.

SUMMARY OF THE INVENTION

Generally speaking, splash resistance is improved by constricting the drinking orifice and beverage flow is improved by increasing the drinking orifice and these two requirements are mutually conflicting. At the heart of the present invention is the discovery that when the dispensing well in the lid is closed at the bottom and two nearly vertical side openings are placed in a generally opposed relationship in the dispensing well, an unexpected improvement in splash resistance is achieved despite the naturally increased area of the two openings. In addition, since the two openings have greater flow area as compared to a single opening that is similar in size to one of the two openings, they also provide improved beverage flow (compared to the single opening), thereby providing an optimized lid construction that features improved beverage flow as well as improved splash resistance.

Without being bound to any fluid flow theory, it is believed that the opposing first and second flow openings (or, in some embodiments, the first and second set of openings), in combination with the bottom wall, provide a synergistic effect in various splash circumstances. In particular:

(1) beverage splashes resulting from a certain volume of fluid rising upwardly from its normal level in the cup impinge on the bottom wall of the dispensing well and are deflected back into the cup;

(2) if a certain volume of splashed beverage emerges from the first opening it can, at least partially, flow through the second opening and drain back into the cup, rather than the entire volume being splashed out of the dispensing well;

(3) if a certain volume of splashed beverage emerges from the second opening it can, at least partially, flow through the first opening and drain back into the cup, rather than the entire volume being splashed out of the dispensing well; and (4) if a certain volume of splashed beverage emerges from both the first and second openings concurrently, then the flow fronts through the first and second openings impinge against each other and reverse direction, such that a substantial quantity of the beverage drains back into the cup. This splash possibility is analogous to momentum transfer when two balls traveling in opposing directions collide against each other and reverse directions.

Which of the above splash circumstances actually manifest or are predominant may depend on a number of factors, including lid construction features such as the location, orientation, size, and shape of the openings, the amount of beverage in the drinking cup, the intensity of agitation of the beverage in the drinking cup due to sudden acceleration or deceleration, the angle at which the cup is held, the type and temperature of the beverage, etc. It will be realized, however, that in normal use, once the cup is tipped towards the user's mouth, the flow cross-sections of the first and second openings (or sets thereof) work cooperatively to deliver greater beverage flow through the dispensing well of the lid.

In certain embodiments of the present invention, the bottom wall of the dispensing well is nearly horizontal when the cup is upright, or is modestly inclined from the horizontal, such that a substantial majority of beverage splashes that are directed upwardly from the cup, due to motion or agitation, impinge on the bottom wall and are deflected back into the cup. In various embodiments the bottom wall may be either modestly inclined towards the center of the lid, or modestly inclined towards the periphery of the lid. While the bottom wall is effective in deflecting an upward splash, to prevent swirling masses of beverage that flow circumferentially from entering the dispensing well, downwardly projecting end walls are provided in some embodiments on either side of the dispensing well. And in various embodiments, the openings lie in a curved plane, so that the circumferential beverage flow will be tangential to the openings. In some embodiments, additional baffle walls are provided around the dispensing well openings so as to further block agitated beverage splashes from approaching or entering the dispensing well area.

A lid for a drinking cup according to an embodiment of the invention includes a raised drinking spout proximate the outer lid periphery having a spout front or outer wall, a top wall and a spout inner or back wall, a dispensing well formed in the top wall of the drinking spout, a bottom wall defining the bottom of the dispensing well and serving as a baffle or splash deflector, a pair of mutually opposed side openings (or one set of openings opposite another set of openings) provided in the dispensing well, wherein one of the side openings is proximate the spout front or outer wall and one of the side openings is proximate the spout back or inner wall, a downwardly projecting first end wall between the two openings at one end of the dispensing well, and a downwardly projecting second end wall between the two openings at another end of the dispensing well.

In certain embodiments, additional baffle walls are provided on the underside of the lid on either side of the dispensing well, i.e. in-between the dispensing well and spout front wall and in-between the dispensing well and the spout back wall to further reduce the volume of splashed fluid that may find a pathway to the dispensing well openings, thereby enhancing the splash resistance of the lid.

The side openings in the dispensing well allow fluid communication with the drinking cup, but have a nearly vertical orientation, or are inclined at a modest angle from the vertical to minimize direct splashes of beverage from the drinking cup when it is held or carried in an upright orientation. The side openings in the dispensing well lie in planes that are nearly vertical or inclined at angles not exceeding +/−30 degrees from vertical, preferably +/−20 degrees from vertical, and most preferably +/−10 degrees from vertical, when the lid is mounted on an upright drinking cup. The side openings may be inclined at the same angle, or one side opening may be inclined more or less than the opposite side opening. The two openings have a comparable flow area and can be identical in size, or one of the openings can be larger than the other opening but preferably no larger than 1.5 times the area of the smaller opening.

The first and second end walls and the bottom wall of the dispensing well are configured to block a substantial majority of the direct paths for a liquid beverage to splash out of the cup, by requiring that splashed liquid at least partially impacts the inner walls of the lid before entering through at least one of the openings in the dispensing well. Furthermore, the mutually opposed openings provide to the splashed fluid entering the dispensing well an opportunity to at least partially drain back into the cup through one of the openings.

When the cup is tipped during normal drinking, there is ample liquid pressure to cause the liquid to flow freely out of the cup. However, when the beverage inside a generally upright cup is in turbulence, caused for example by abrupt acceleration or deceleration in a vehicle, or by general movement and shaking of user's hands while walking, a mass of fluid may be agitated upwardly and impact the bottom wall or the first and second end walls, and/or the lower edges of the baffle walls. The fluid-mass will then be sub-divided into the respective channels and the momentum and kinetic energy of the fluid mass will be substantially reduced, due at least in part to surface tension and frictional effects. In other words, the retarding effect created by the resistance between the liquid and the bottom wall of the dispensing well, combined with the relatively low mass of the sub-divided stream of fluid in a channel, tend to decrease the momentum of the initial splash significantly, and thereby to decrease the likelihood that a small spill or droplet will fully exit the cup during a splashing event.

Depending on the nature of the liquid and the splashing event, a splashed fluid mass may be comparable or larger in size than the bottom wall of the dispensing well thereby causing a portion of the splashed fluid mass impinging the bottom wall to be diverted back into the cup, while the rest of the splashed fluid mass will hit the top wall surrounding the dispensing well or the lower edges of any baffle walls. As a result, all but the most energetic droplets will be blocked from exiting the cup.

Various embodiments include one or more vent holes in the lid that permit air to enter the cup and equalize the internal pressure as a beverage is consumed. Certain of these embodiments include a plurality of vent holes. In some of these embodiments, the plurality of vent holes includes vent holes of different sizes that are selectively located so as to control the maximum rate at which a beverage can flow from the cup.

In some embodiments wherein the lid is intended for use with hot beverages, one or more vent holes are located in proximity to the drinking spout or the dispensing well, so that when the cup is full and the beverage in the cup is hot, tipping of the cup from vertical beyond a certain angle causes the beverage to block vent holes near the dispensing well, thereby reducing the rate of liquid flow out of the cup. It will be appreciated by those skilled in the art that a typical user tilts the cup towards his or her mouth to consume the beverage therefrom, and has a tendency to consume the beverage in smaller sips when the beverage is hot. Thus, blocking of some of the vent holes complements the natural tendency of the user to consume beverage at a slower rate when the cup is full and the beverage is hot. As the cup is emptied and the beverage cools, the level of liquid falls, and some of the previously blocked vent holes are uncovered, thereby increasing the liquid flow rate.

The present invention is a lid for use with a drinking vessel. The lid includes a peripheral rim configured for engaging with said drinking vessel, a raised drinking spout proximal to said peripheral rim, said drinking spout comprising an outer spout wall extending upwardly from said peripheral rim, and a spout top wall connected to said outer spout wall, said drinking spout being configured for allowing consumption of a beverage contained within an interior of said drinking vessel by a user, and a dispensing well formed within said spout top wall, said dispensing well comprising at least a bottom wall, a first opening proximate said outer spout wall, and a second opening located opposite to said first opening, wherein said bottom wall is closed for substantially blocking splashes of a beverage contained in said drinking vessel.

In embodiments, the drinking spout further comprises an inner spout wall extending upwardly from a central portion. And in some of these embodiments, the second opening is located proximate said inner spout wall.

In various embodiments the dispensing well further comprises first and second end walls, and wherein said bottom wall connects said first and second end walls. In some embodiments, the bottom wall of said dispensing well is inclined.

Embodiments further include at least one vent hole that provides air communication between the interior of the drinking vessel and air exterior to the lid. In some of these embodiments, a diameter of the vent hole is less than 0.060 inches. In other of these embodiments, a diameter of the vent hole is approximately 0.032 inches.

Various embodiments further include a plurality of vent holes that admit air into the interior of the drinking vessel as the beverage in the drinking vessel is consumed. In some of these embodiments, at least a first vent hole amongst said plurality of vent holes is located proximate said dispensing well. In other of these embodiments the plurality of vent holes includes a plurality of vent hole sizes.

Embodiments further include a plurality of vent holes located at a plurality of proximities from said dispensing well, wherein at least one vent hole amongst said plurality of vent holes is blocked by said beverage when the drinking vessel is substantially full of beverage and is tipped towards the user for drinking therefrom.

In certain embodiments at least one surface of the lid includes at least one of a texture and a protruding structure configured to influence a flow of said beverage across said at least one surface. In some embodiments the lid is constructed from at least one of paper, plastic, thermoplastic resin, foam, a laminated material, a compostable resin, and a biodegradable material. In other embodiments the lid is manufactured by one of thermoforming, injection molding, compression molding, vacuum forming, pressure forming, and hydro forming.

In various embodiments, the lid is injection molded from a suitable grade of polypropylene resin. In certain embodiments the lid is injection molded from a plastic material. In some embodiments, the lid is disposable.

In embodiments, the lid is compatible for use with a drinking vessel that is configured for holding and dispensing a drinkable fluid that is one of tea, coffee, soup, shake, juice, and milk.

Embodiments further include at least one interior baffle wall disposed around the dispensing well and configured to inhibit fluid that is at least one of swirling and laterally-splashing from entering the dispensing well. And in some of these embodiments the at least one interior baffle wall connects end walls of the dispensing well with the outer spout wall and with an inner spout wall extending upwardly from a central portion of the lid.

In embodiments, the bottom wall of the dispensing well is substantially horizontal. In various embodiments, the first and second dispensing well openings are inclined from vertical by an angle of less than 30 degrees, less than 20 degrees, or less than 10 degrees. In certain embodiments, the first and second dispensing well openings do not differ from each other in area by more than 30%, and in some embodiments the first and second dispensing well openings do not differ from each other in area by more than 15%.

In various embodiments, the combined area of the first and second dispensing well openings is at least 0.06 $in^2$, at least 0.08 $in^2$, or at least 0.09 $in^2$.

And in certain embodiments, a combined area of the first and second dispensing well openings is between 0.08 $in^2$ and 0.2 $in^2$, between 0.10 $in^2$ and 0.25 $in^2$, or between 0.04 $in^2$ and 0.12 $in^2$.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

Figure 1:
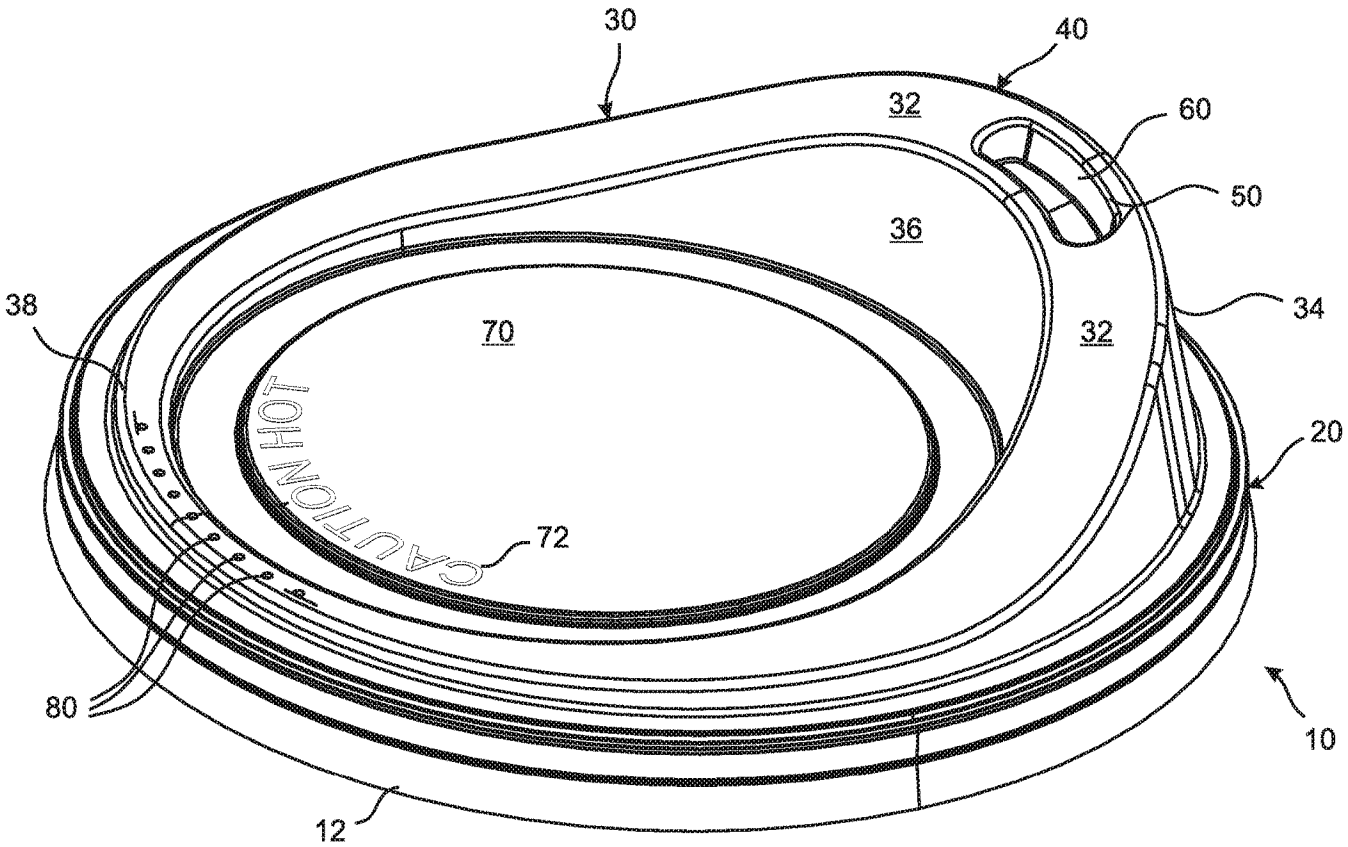
FIG. 1 is a perspective side view of a lid according to an embodiment of the present invention showing a raised spout on the right, a dispensing well within the raised spout and a dispensing well opening proximate the outer spout wall.

The present invention is generally directed towards a lid that engages with a drinking cup or a similar vessel, and allows a user to drink therefrom while naturally inhibiting splashing and spilling of the beverage from the drinking cup without requiring use of an orifice sealing device, and without requiring the user to plug and unplug the drinking orifice with a connected or separate plug member. The following description of one or more exemplary embodiments, in conjunction with accompanying drawings of representative lids, is offered as illustrative of the invention, but should not be regarded as restricting the scope of the invention.

The lid constructions according to at least some embodiments of the present invention offer particular utility for disposable drinking cups, which are typically used for holding cold and hot beverages, and are generally constructed from paper, plastic, or foam materials. It will be apparent to those skilled in the art that the lid embodiments described herein can be utilized with and/or adapted for reusable cups and drinking vessels made from plastic, foam or other materials. The lid of the present invention can be utilized for consuming all kinds of hot and cold beverages, including coffee, tea, soup, shakes, frappes, and slush drinks. The lid of the present invention can also be used in combination with disposable or reusable cups for children of all ages. According to still other embodiments of the invention, the spout and dispensing well constructions of the lid can be used for dispensing fluid materials including dressing, vinegar, coffee cream, etc.

With reference to FIGS. 1 through 9, there are shown various views and sections of lid 10 according to an embodiment of the present invention wherein like reference numerals represent like parts. It will be realized that not all parts are visible or indicated in all views. Lid 10 has a generally round outwardly flared skirt 12, to allow the lid to be easily guided onto a drinking cup (shown in cross-sectional view of FIG. 9) and includes a peripheral grip portion 20 that is designed to be securely but removably attachable along the beaded rim or periphery of the drinking cup in a fluid tight relationship, as is known in the art.

Lid 10 includes an annular portion 30 connected to the peripheral grip portion 20. Annular portion 30 circumscribes a relatively shallow round central portion 70. The central portion 70 may also feature information such as a warning, a logo, use instructions, and/or another message for the user, and is generally denoted by indicia 72. Indicia 72 can be molded-in, i.e. integrally generated while molding or forming the lid 10. Alternately, indicia or message 72 can be customized for the user, customer or restaurant by printing, embossing, heat transfer or stamping processes after molding or forming the lid.

The central portion 70 is dimensioned appropriately to allow a user to stack another cup assembly on top of lid 10, thereby allowing a user to carry two lidded drinking cups with one hand, at least for a short distance or duration, such as while walking to a table in a restaurant or to the car. The annular portion 30 rises from the central portion 70 at one end to form a raised drink spout 40 that allows a user to comfortably accommodate his/her lips around the drink spout 40, and prevents the user's nose from touching the central portion 70. The annular portion 30 has a relatively shallow end 38 located opposite to the raised drink spout 40. The drink spout 40 comprises a top wall 32, outer spout wall 34, and inner spout wall 36. A dispensing well 50 is provided in the top wall 32 of the drinking spout 40, centered at or near the crest thereof. Top wall 32, outer spout wall 34, and inner spout wall 36 all descend gradually from either side of the raised drink spout 40 towards shallow end 38, and wrap around circular portion 70 to form the annular portion 30.

Dispensing well 50 establishes communication with the beverage inside the drinking cup and enables a user to consume a beverage from the drinking cup without removing lid 10 therefrom. The outer spout wall 34 can be made slightly taller than the inner spout wall 36 near the dispensing well 50, so that a user may drink comfortably without his/her lower lip coming in contact with the peripheral grip portion 20. In consuming the beverage from the drinking cup to which lid 10 is attached, a user places his/her lips around the dispensing well 50, such that the user's lower lip is in contact with the outer spout wall 34 and the user's upper lip is in contact with the inner spout wall 36. The cup is then tilted until the beverage flows from the openings provided in the dispensing well and into the user's mouth.

Figure 2:
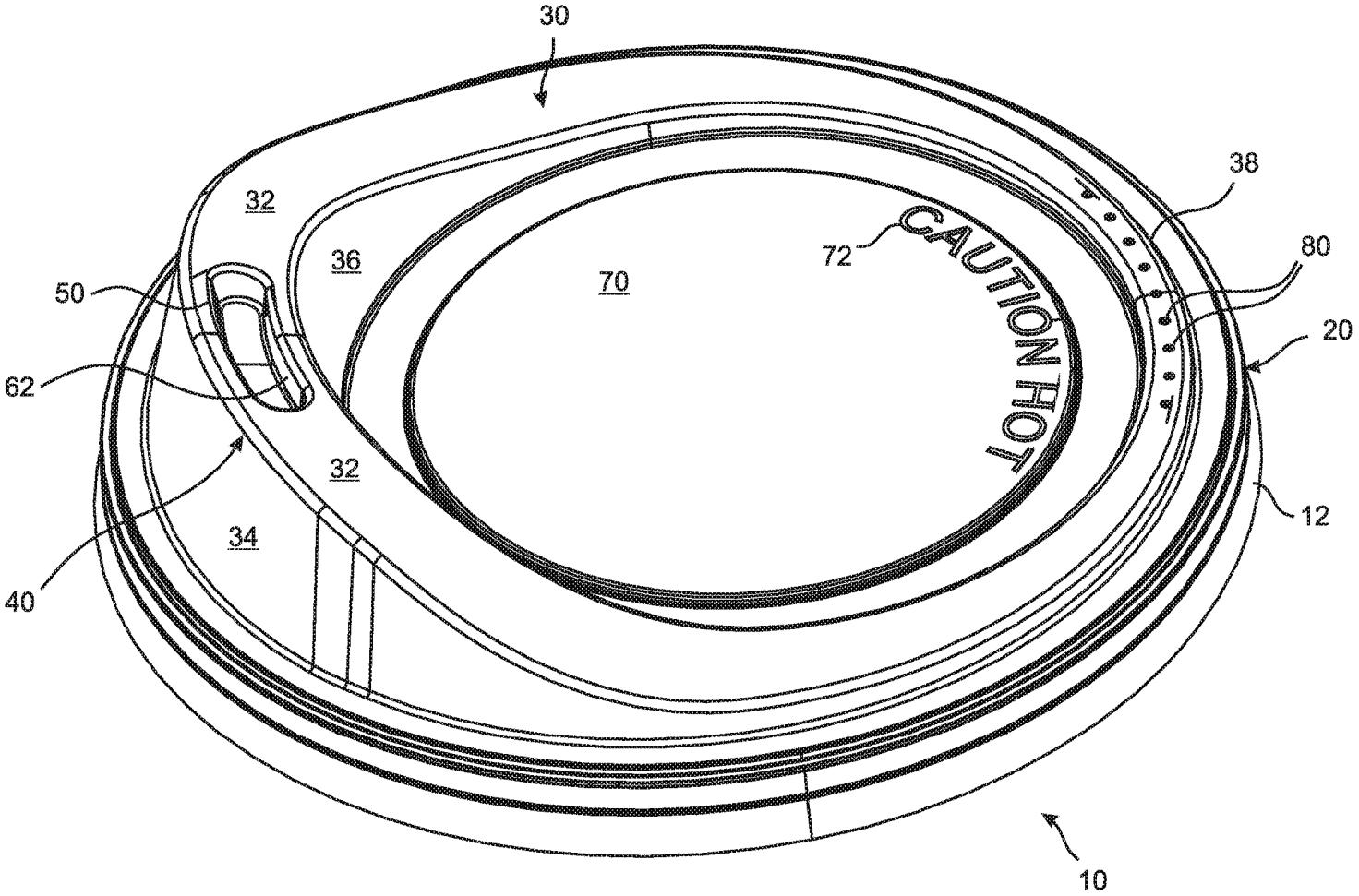
FIG. 2 is a perspective side view of a lid according to an embodiment of the present invention that shows a raised spout on the left, a dispensing well within the raised spout and a dispensing well opening proximate the inner spout wall.
Figure 3:
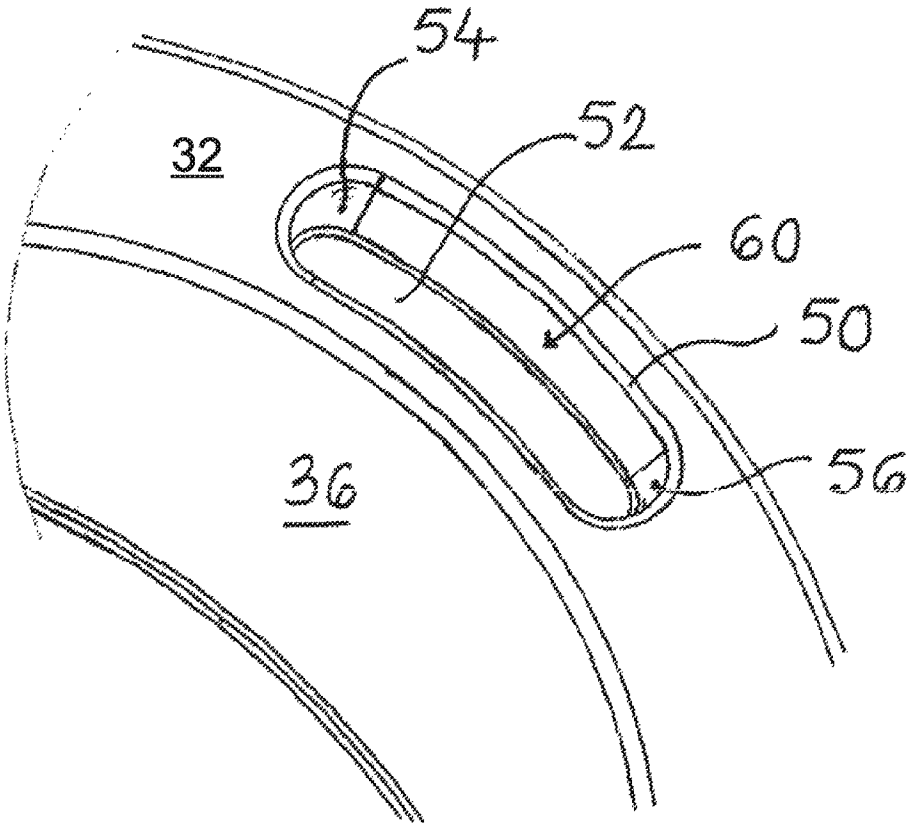
FIG. 3 is a close-up perspective view of the dispensing well in the same general orientation shown in FIG. 1.
Figure 4:
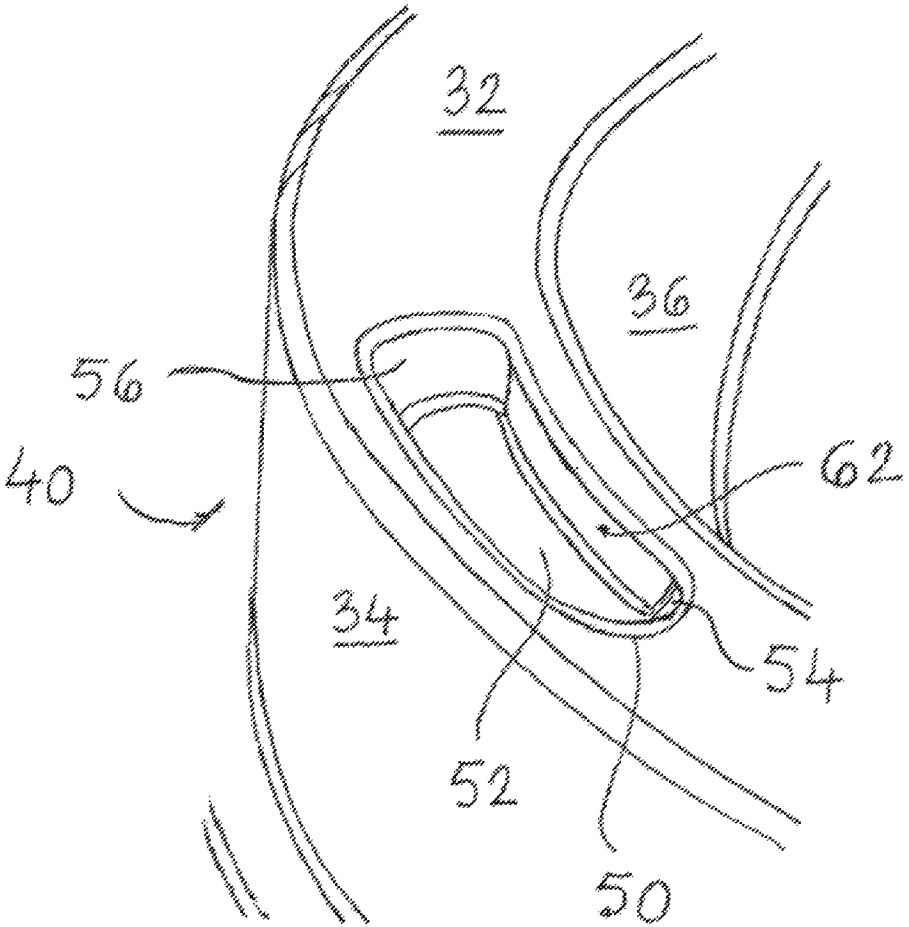
FIG. 4 is a close-up perspective view of the dispensing well in the same general orientation shown in FIG. 2.

Dispensing well 50 is equipped with certain splash resistant features. The construction of the dispensing well is shown in the enlarged views of FIGS. 3 and 4. FIG. 3 shows an enlarged view of the dispensing well 50 in the same general orientation of the lid 10 as is shown in FIG. 1. Similarly, FIG. 4 shows an enlarged view of the dispensing well 50 in the same general orientation of the lid 10 as is shown in FIG. 2. The dispensing well 50 includes end walls 54 and 56 protruding downwardly from the top wall 32 into the interior of the lid. The lower edges of end walls 54 and 56 in the dispensing well 50 are connected to a bottom wall 52. The bottom wall 52 serves as the primary baffle or splash deflector, such that most of the direct beverage splashes from the drinking cup impinge the underside of the bottom wall 52 and are deflected back into the drinking cup. A pair of dispensing well openings 60 and 62 are provided in the dispensing well 50 opposite to one another, such that the well opening 60 is proximate the outer spout wall 34 and the well opening 62 is proximate the inner spout wall 36. In the enlarged view shown in FIG. 3 only the opening 60 is visible, while in the enlarged view shown in FIG. 4, only the opening 62 is visible.

Figure 5:
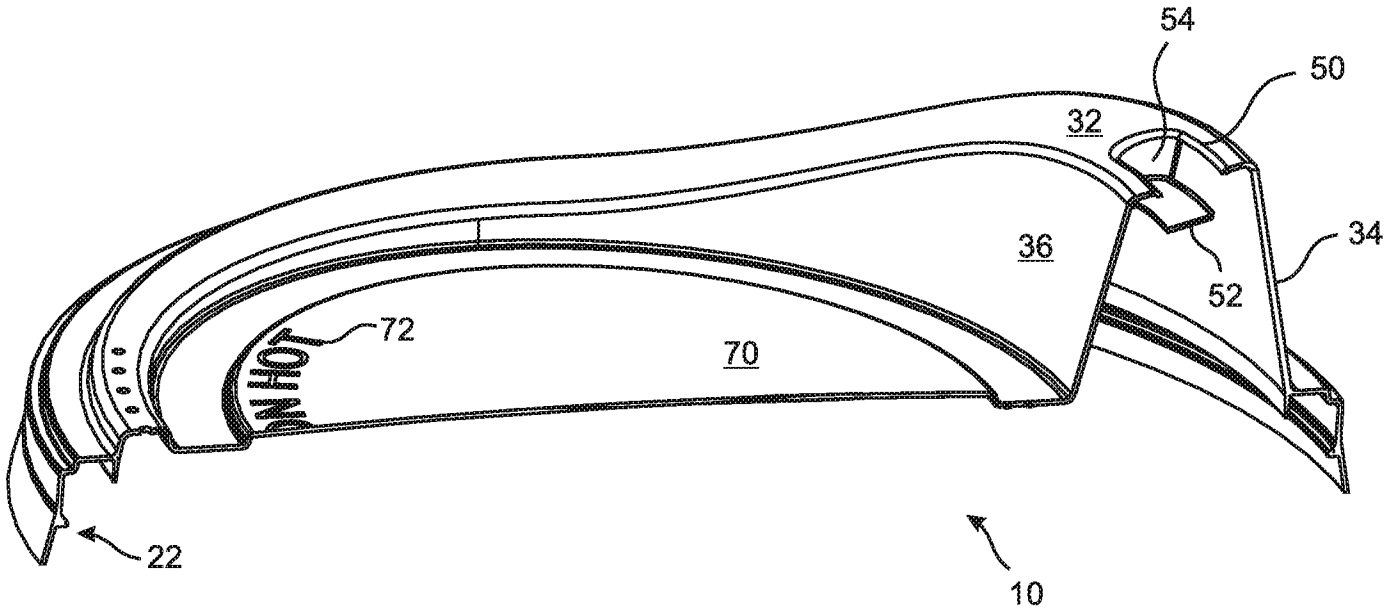
FIG. 5 is a sectional perspective view through the drinking spout of the lid shown in FIG. 1.

FIG. 5 shows a sectional view of the lid 10 through the spout 40 in an orientation similar to FIG. 1, showing raised spout 40 on the right, wherein the relative arrangement of the two openings in the dispensing well 50 is shown. The sectional view of the dispensing well 50 of FIG. 5 is shown in an enlarged form in FIG. 6. The sectional plane passes through openings 60 and 62 that are shown via dotted lines for ease of viewing and description. The dispensing well openings 60 and 62 have a nearly vertical orientation when the cup-lid assembly is in an upright position, such that direct line-of-sight paths for beverage splashes are avoided, or at least minimized. Beverage splashes that are vertically directed will mostly impinge upon the underside of the bottom wall 52 of the dispensing well or the underside of the top wall 32 and very little fluid will escape through the openings 60 and 62, because of their nearly vertical orientation.

It will be realized that, for ease-of-molding and manufacturability reasons, in various embodiments the openings 60 and 62 are inclined at an angle to the vertical. Preferably, the openings 60 and 62 are inclined less than 30 degrees from the vertical axis, more preferably the openings are inclined less than 20 degrees from the vertical, and most preferably less than 10 degrees from the vertical. As will also be clear from FIGS. 5 and 6, the openings 60 and 62 are generally disposed opposite to each other, such that splashes that have a flow component in the horizontal direction, upon entering the dispensing well through one of the openings, will have an opportunity to be diverted back into the cup through the opposite opening.

Figure 7:
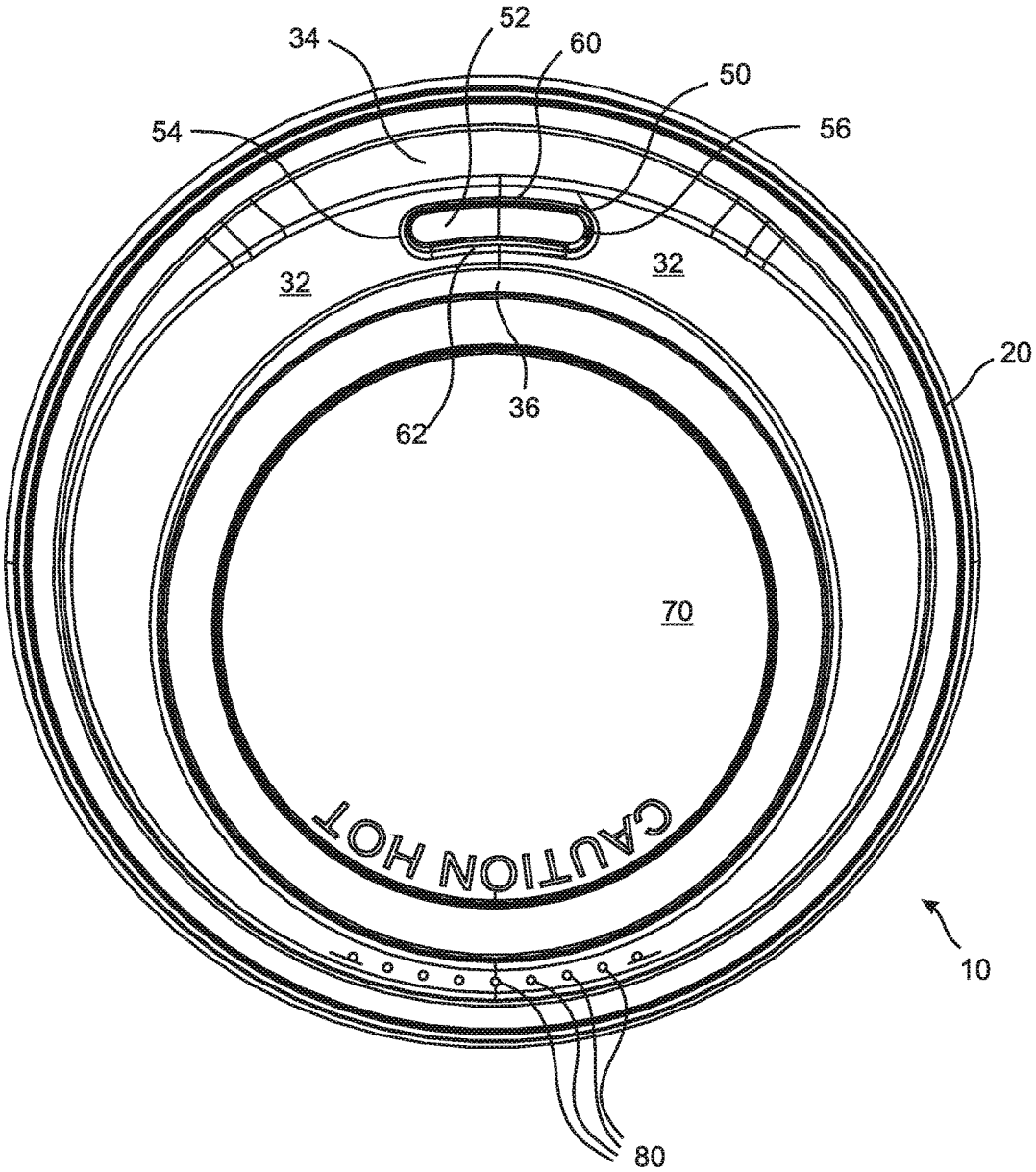
FIG. 7 is a top view of a lid similar to those shown in FIGS. 1-6.
Figure 8:
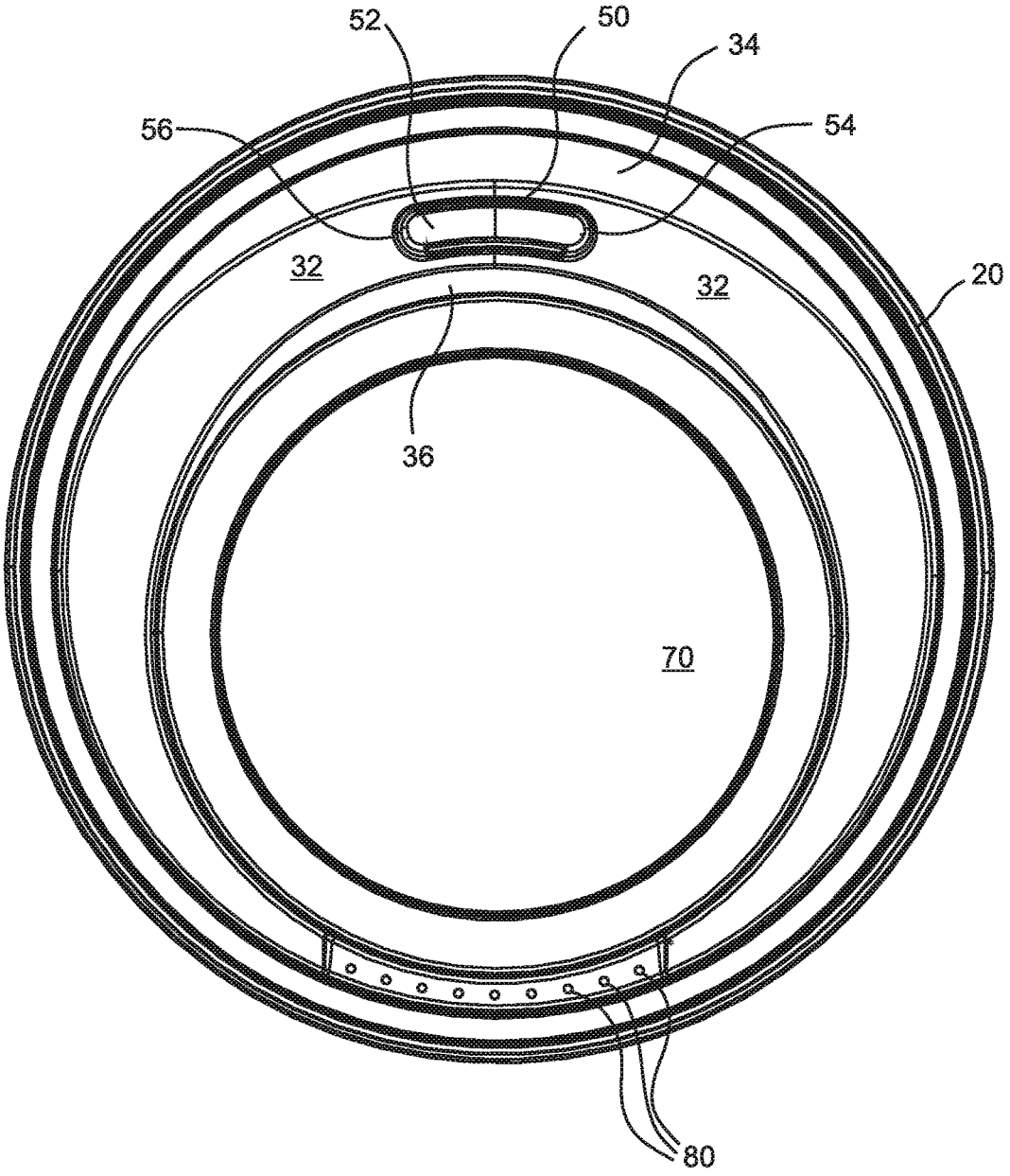
FIG. 8 is a bottom view of the lid shown in FIG. 7.

The relative arrangement of the dispensing well openings 60 and 62 is also shown in FIGS. 7 and 8, wherein FIG. 7 provides a top view of lid 10 that will be visible to a user when the lid is mounted on a drinking cup, while FIG. 8 provides a bottom view of the lid 10 from its interior or underside that will be in contact with the beverage splashes when mounted to a drinking cup. FIG. 8 shows the underside of the bottom wall 52 of the dispensing well 50, which serves as the primary baffle for deflecting beverage splashes. Due to their nearly vertical orientations, the dispensing well openings 60 and 62 appear merely as narrow slits in both FIGS. 7 and 8.

The bottom wall and the opposing openings 60 and 62 provide a synergistic effect in various splash circumstances:

(1) The bottom wall 52 serves as the primary baffle deflecting any upwardly bound splashes from the normal fluid level in the drinking cup;

(2) if a certain volume of splashed beverage emerges from the opening 60 it can, at least partially, flow through the opening 62 and drain back into the cup rather than the entire volume being splashed out of the dispensing well 50;

(3) if a certain volume of splashed beverage emerges from the opening 62 it can, at least partially, flow through the opening 60 and drain back into the cup rather than the entire volume being splashed out of the dispensing well 50; and (4) if the splashed beverage emerges from both the openings 60 and 62 concurrently, then the flow fronts through the openings 60 and 62 will impinge against each other and reverse direction, such that a substantial quantity of the beverage drains back into the cup, in a manner similar to momentum transfer when two balls traveling in opposing directions collide against each other and reverse directions.

The frequency and/or probability of occurrence of the above splash circumstances will depend on a number of factors, including lid construction features such as location, orientation, size and shape of the openings, the amount of beverage in the drinking cup, the intensity of agitation of the beverage in the drinking cup due to sudden acceleration or deceleration, the angle at which the cup is held, the type and temperature of the beverage, etc. It will be realized, however, that in normal use, once the cup is tipped towards the user's mouth, the flow cross-sections of the openings 60 and 62 will work cooperatively to deliver greater beverage flow through the spout well of the lid.

The orientation and mutual arrangement of the dispensing well openings 60 and 62 enables reconciliation of conflicting requirements, in that the dispensing well openings do not have to be constricted to provide adequate splash resistance. Thus, the dispensing well openings 60 and 62 provide increased beverage flow through the dispensing well while drinking, and improved splash resistance (i.e. reduced beverage flow) when the cup-lid assembly is upright. The areas of drinking orifices used on typical coffee cup lids at leading coffee chains range from about 0.065 to 0.077 $in^2$ (square inches) based on measurements. In contrast, the combined area of the dispensing well openings 60 and 62 (i.e. sum of areas of individual openings) can be larger than the drink through opening(s) that are typically used on commercial coffee cup lids.

It has been found that the combined area of the dispensing well openings should be at least 0.06 $in^2$ to obtain reasonable beverage flow. According to certain embodiments of the invention, the combined area of openings 60 and 62 is greater than 0.08 $in^2$. According to certain embodiments of the invention, the combined area of openings 60 and 62 ranges between 0.08 and 0.2 $in^2$. According to preferred embodiments of the invention, the combined area of the openings 60 and 62 is between 0.09 and 0.12 $in^2$ for hot beverages such as tea and coffee. It will be realized that viscous and thick fluids such as milk shakes and frappes may require even larger opening sizes and vent holes. According to some preferred embodiments of the invention, the combined area of the dispensing well openings is about 0.10 $in^2$. According to certain embodiments, each of the openings 60 and 62 has an area in the range of 0.04 to 0.08 $in^2$.

It will be recognized that the dispensing well openings 60 and 62 may be of equal size or unequal size. According to some embodiments of the invention, the areas of the dispensing well openings do not differ from each other by more than +/−30%. According to preferred embodiments of the invention, the areas of the dispensing well openings do not differ from each other by more than +/−15%.

Lid 10 also includes a plurality of vent holes 80 configured for allowing air to flow into the cup to replenish the loss of volume due to beverage flowing out of the dispensing well 50 as it is consumed. It will be apparent that the plurality of vent holes 80 can be replaced with a single vent hole of a larger size. However, it will be recognized by those skilled in the art that a larger vent hole may also allow beverage to splash out through the vent hole if the area of the vent hole exceeds a certain threshold size. Based on experiments, the vent hole diameter should be less than 0.060 inches to prevent splashing through the vent hole under normal conditions, and preferably less than 0.040 inches. In certain embodiments, the vent hole diameter is about 0.032 inches. Vent holes with diameters less than 0.032 inches can be employed by using a larger number of vent holes.

Nonetheless, it will be apparent to those skilled in the art that the locations, sizes, shapes and number of the vent holes can be varied according to the features and flow performance desired. For example, a larger number of vent holes can be used for improved beverage flow. Thus, a lid construction can be optimized by manipulating the combined area of the openings in the dispensing well, the vent hole diameter(s) and the number of vent holes.

Figure 9:
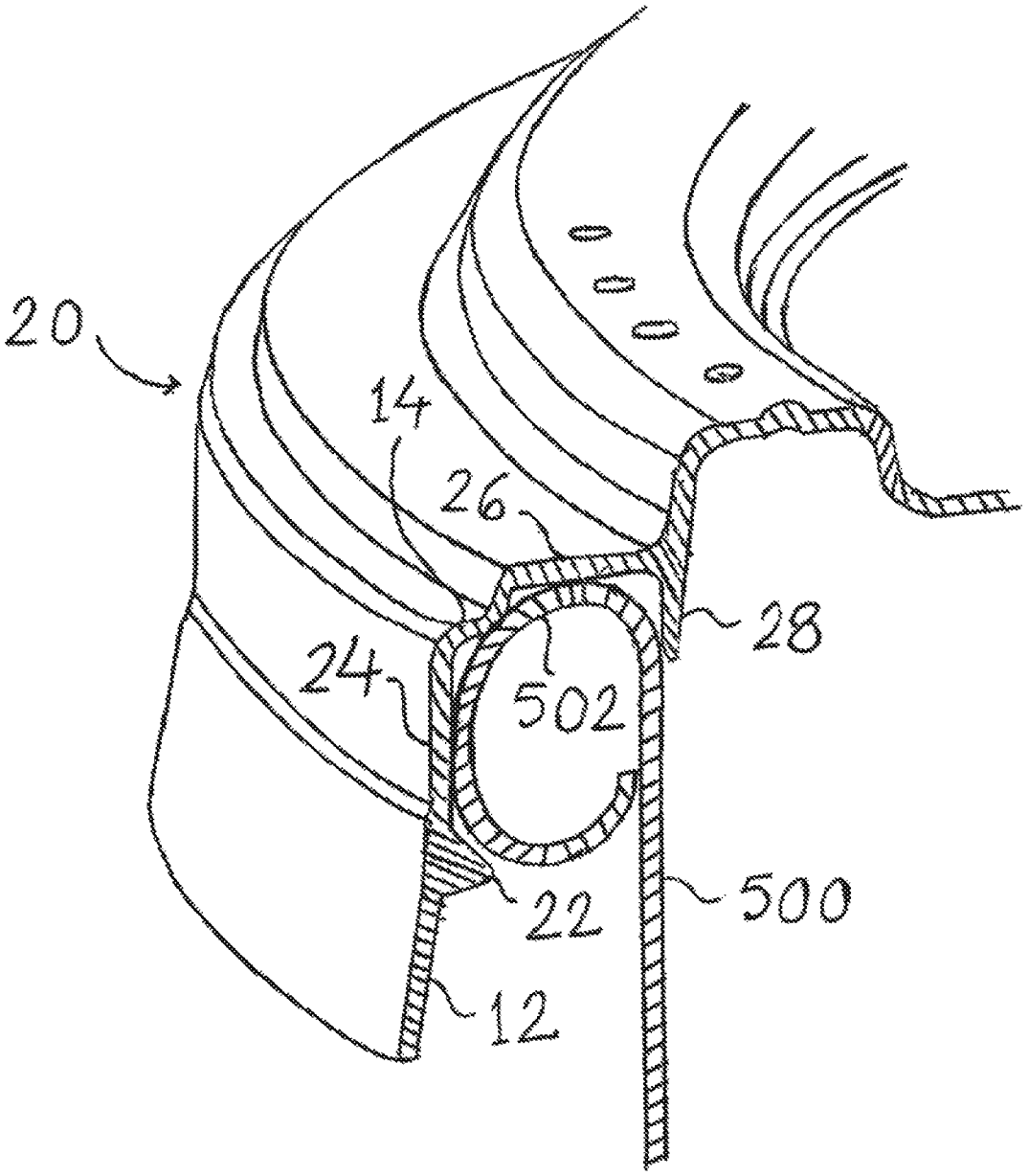
FIG. 9 is a close-up sectional view of the peripheral grip portion of the lid shown in FIGS. 7-8, along with a cooperating cup rim engaged with the lid.

FIG. 9 illustrates an enlarged cross-sectional view of the peripheral grip portion 20 of lid 10, engaged with a drinking cup 500. The drinking cup 500 has a generally rolled rim 502 in engagement with the peripheral grip portion 20 of the lid 10. As shown, the grip portion 20 comprises a channel formed by walls 24, 26 and 28, although other constructions for holding the cup rim can be utilized. A pinched corner or chamfer can be provided at the junction of walls 24 and 26, for ensuring additional contact with the rounded rim 502 of the drinking cup 500. A protruding snap bead 22 is provided in the embodiment of FIG. 9 for securing the roller rim 502 within the grip portion.

Figure 10:
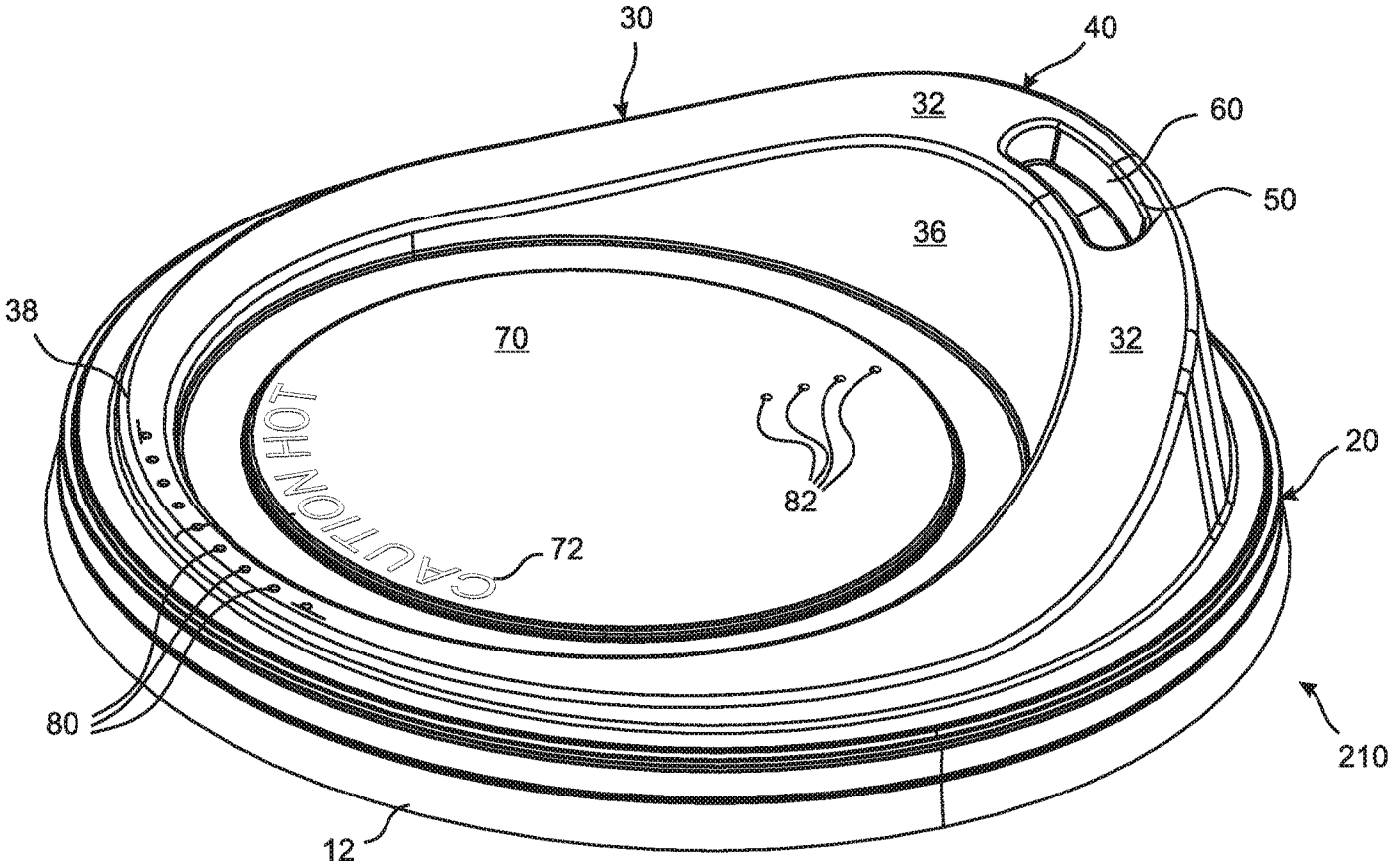
FIG. 10 is a perspective side view of a lid according to another embodiment of the present invention showing a raised spout on the right, a dispensing well within the raised spout, a dispensing well opening proximate the outer spout wall, and two sets of vent holes.

FIG. 10 shows a lid 210 according to another embodiment of the invention, which is similar in construction to lid 10 of FIGS. 1 to 9, except that lid 210 has a different arrangement of vent holes. For ease of description, like parts of lid 210 and lid 10 bear like reference numerals. In the embodiment of FIG. 10, one group of vent holes 80 is located near the periphery of the lid 210 in a region opposite to the drink spout 40, similar to the vent holes of the lid 10 shown in FIG. 1. In addition, lid 210 includes another group of vent holes 82 that are located in the central portion of the lid, proximate the inner spout wall 36 of the drink spout 40. It will be realized that the individual vent holes denoted by reference numerals 80 and 82 can all be the same size, or can vary in size. Two or more vent holes of smaller size can be substituted with a larger vent hole and vice versa. It will further be realized that a larger vent hole can be substituted with two or more smaller vent holes, depending on the vent hole diameter needed for preventing splashes, as discussed above.

Figure 11:
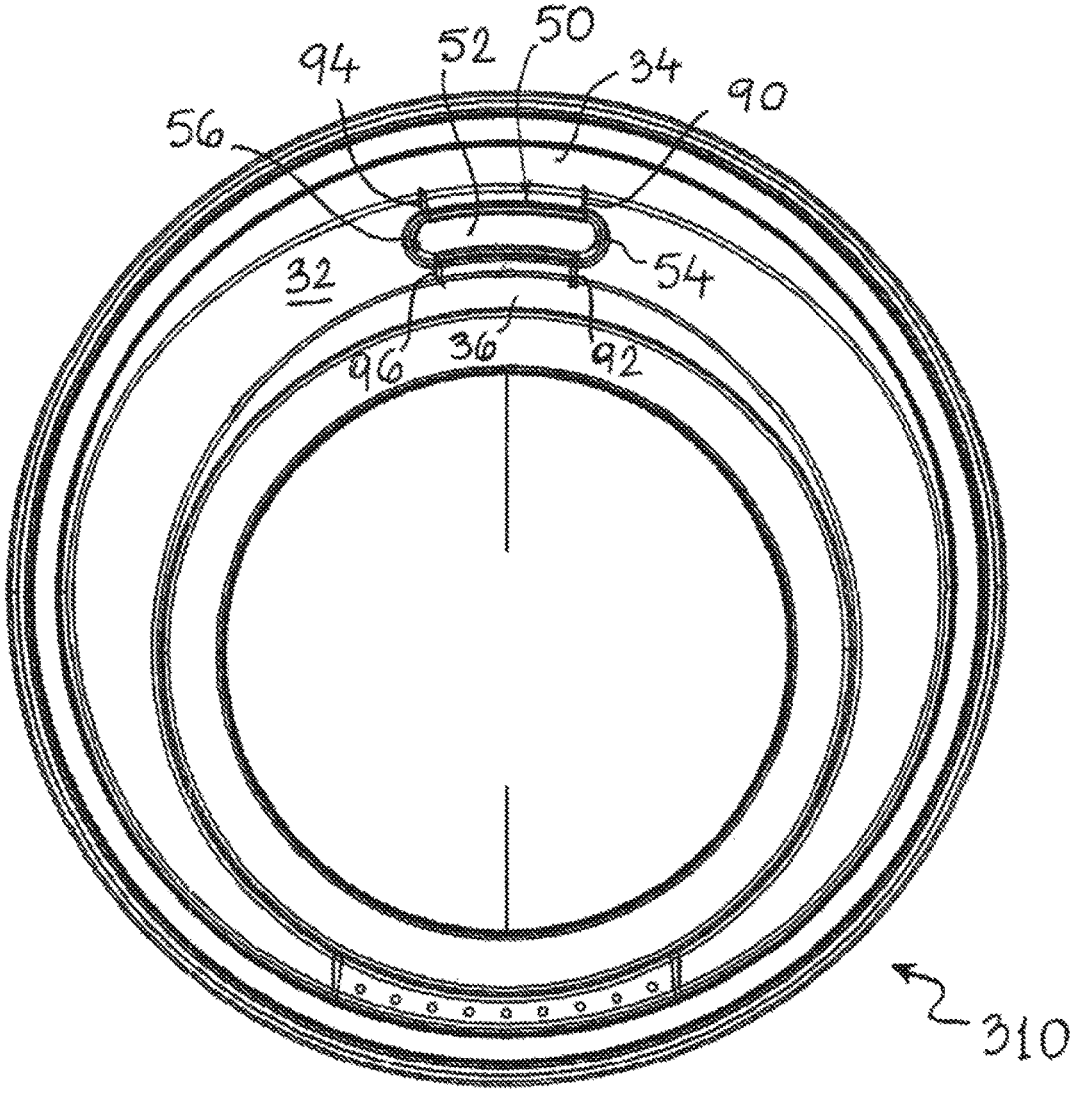
FIG. 11 is a bottom view of a lid according to yet another embodiment of the present invention comprising baffles positioned around the dispensing well openings.
Figure 12:
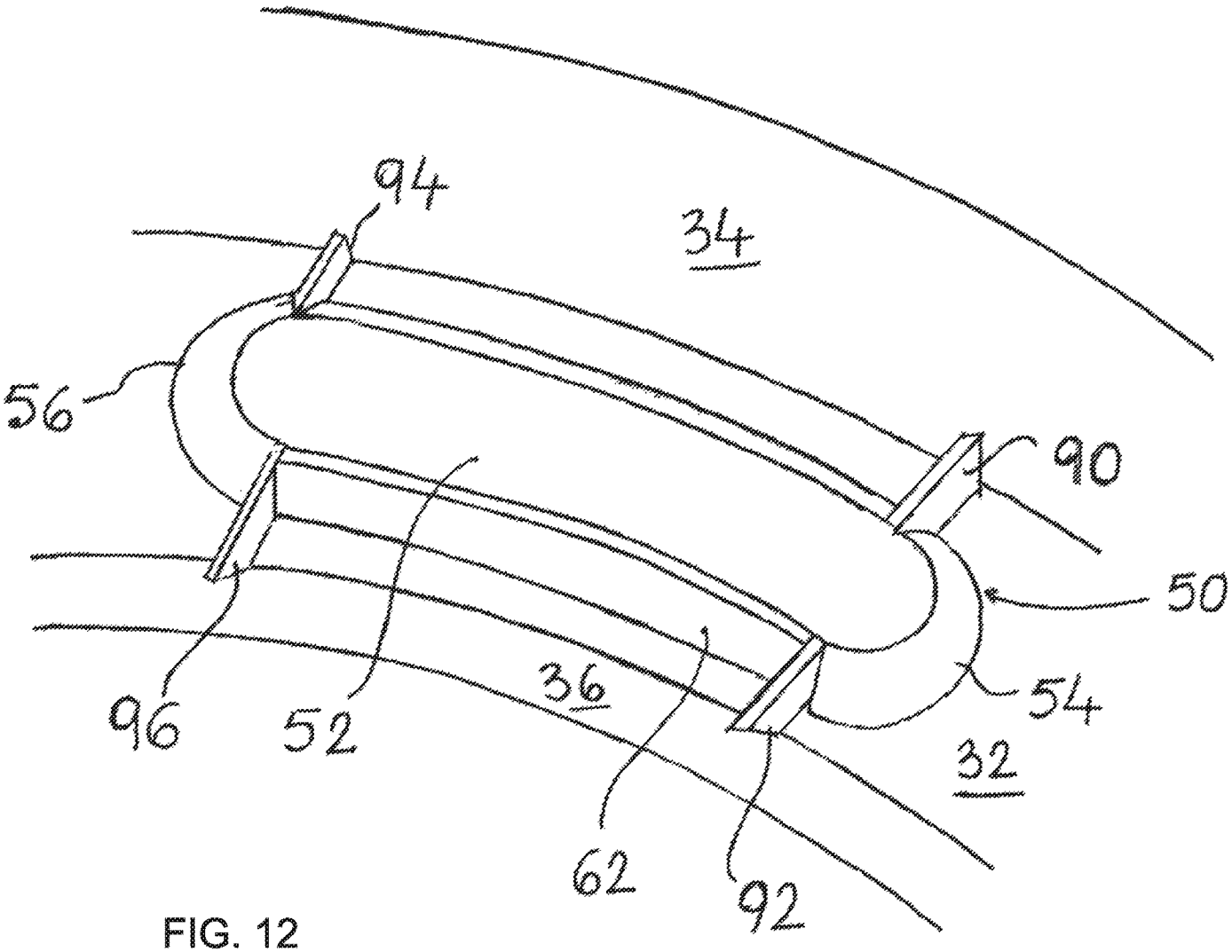
FIG. 12 is a close-up perspective view from the bottom of the dispensing well of the lid shown in FIG. 11, showing the relationship between the baffle walls, dispensing well openings, dispensing well end walls, and the spout outer and inner walls.
Figure 13:
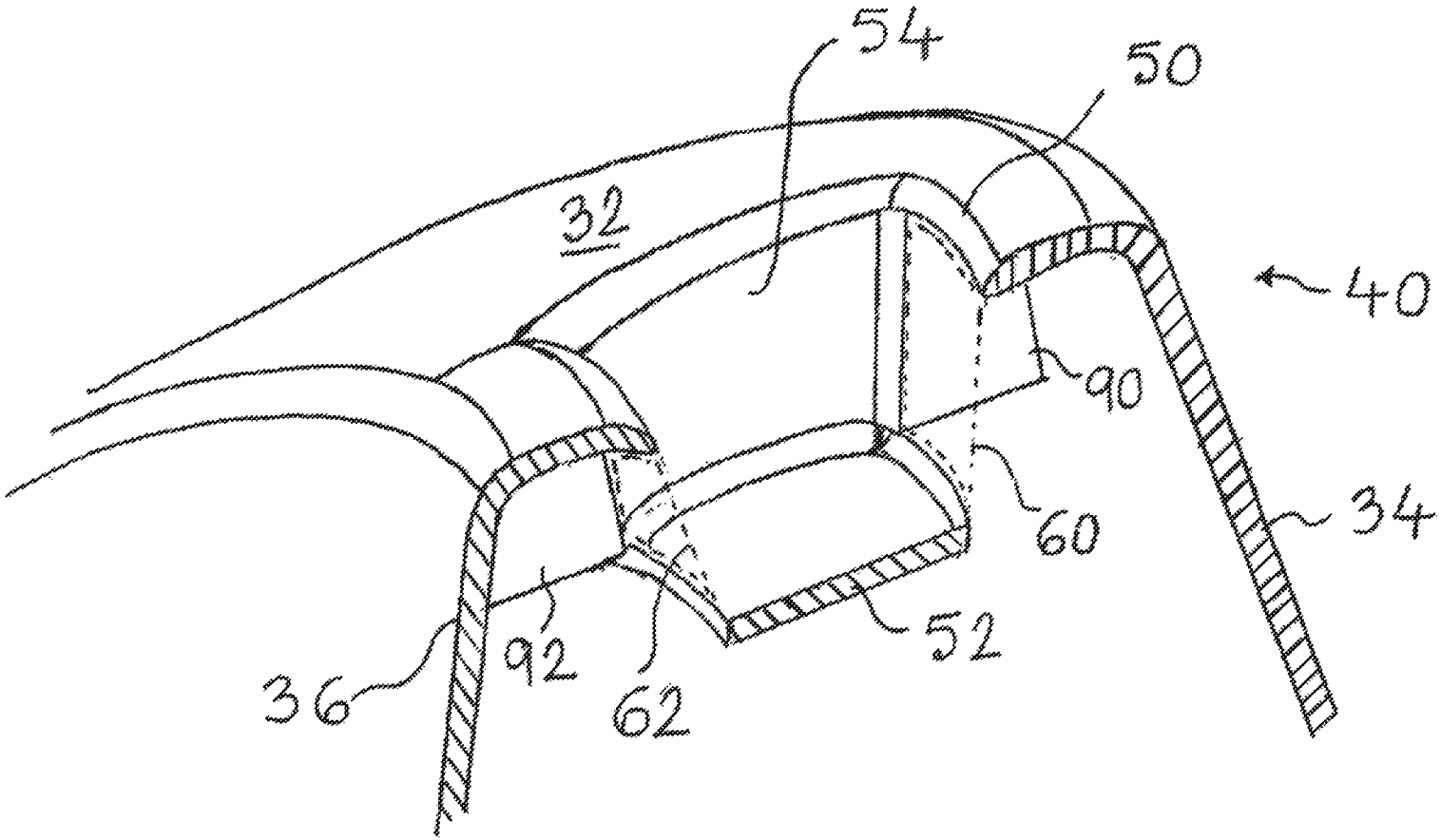
FIG. 13 is a close-up sectional view of the dispensing well shown in FIGS. 11 and 12 showing the relative arrangement of the baffle walls, dispensing well openings, dispensing well end wall, dispensing well bottom wall, and the spout outer and inner walls.

FIGS. 11 through 13 show a lid 310 according to another embodiment of the invention which is similar in construction to lid 10 of FIGS. 1-9, except that lid 310 includes additional interior baffle walls proximal to the dispensing well that further channel and restrict the flow of splashed beverage. In particular, FIG. 11 is a view from the bottom or underside of lid 310, similar to FIG. 8. Once again, like reference numerals represent like parts. As shown in FIG. 11, lid 310 includes dispensing well 50 bounded by end walls 54 and 56, and includes a bottom wall 52, similar to lid 10. Dispensing well openings 60 and 62 (not identified in the bottom view of FIG. 11) appear merely as narrow slits because of their nearly vertical orientations. Lid 310, includes baffle walls 90 and 92 on either side of end wall 54, wherein baffle wall 90 connects end wall 54 with outer spout wall 34, and baffle wall 92 connects end wall 54 with inner spout wall 36. Similarly, baffle walls 94 and 96 are provided on either side of end wall 56, wherein baffle wall 94 connects end wall 56 with outer spout wall 34, and baffle wall 96 connects end wall 56 with inner spout wall 36.

Baffle walls 90, 92, 94, and 96, collectively, serve to restrict swirling or laterally-splashing masses of beverage inside the drinking cup from entering the dispensing well as the drinking cup is being held by the user or is otherwise subjected to agitation and movement.

A close-up perspective view of the dispensing well 50 from the bottom or underside of lid 310 is shown in FIG. 12. In this view, the dispensing well opening 62 is visible, and the arrangement of the baffle walls 90, 92, 94, and 96 relative to the end walls 54 and 56, spout outer wall 34, and spout inner wall 36 can be readily seen. Baffle walls 92 and 96 serve to prevent lateral or swirling masses of beverage from reaching dispensing well opening 62. Similarly, baffle walls 90 and 94 prevent lateral or swirling masses of beverage from reaching the dispensing well opening 60 (not shown in FIG. 12).

Figure 6:
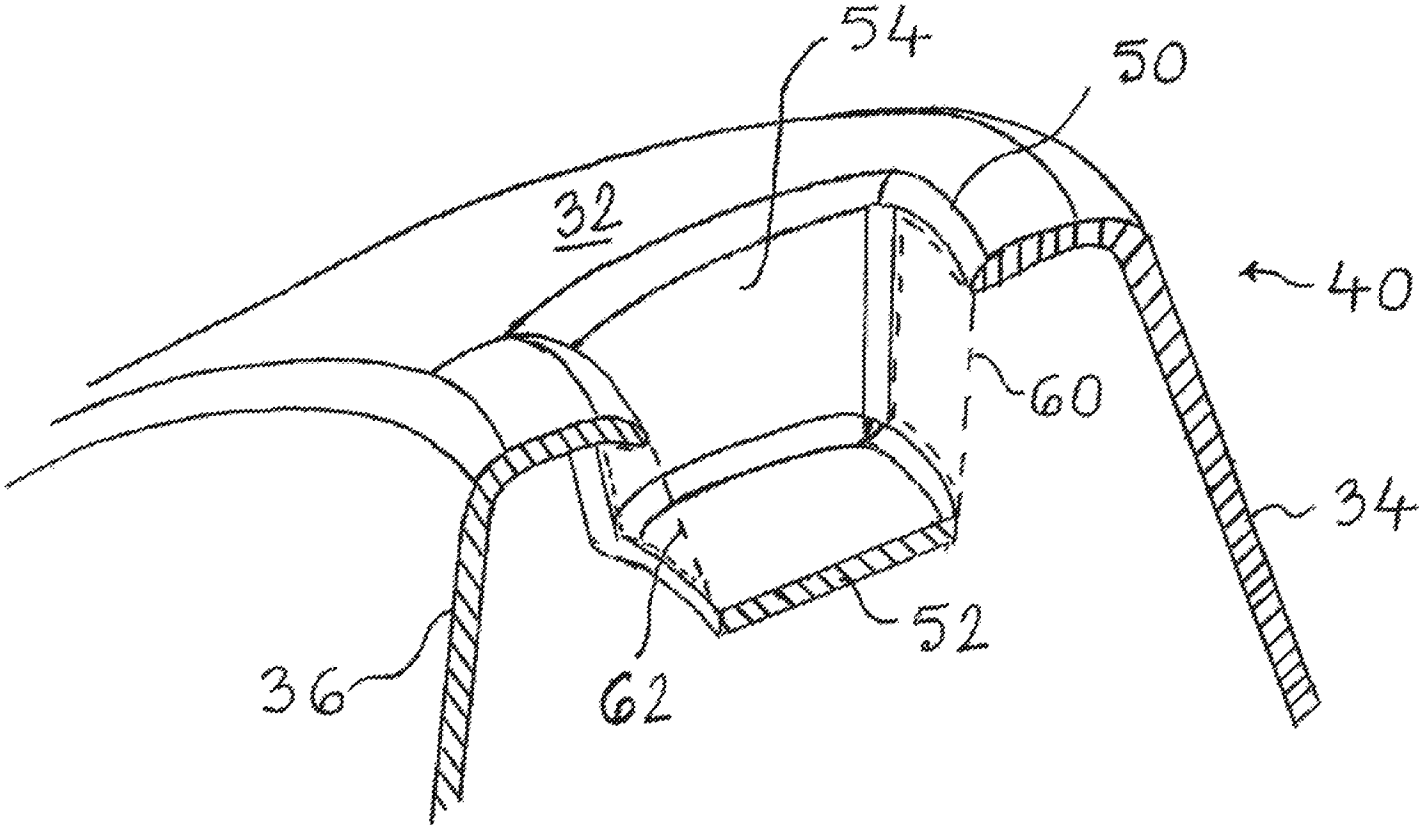
FIG. 6 is a close-up sectional view of the drinking spout shown in FIG. 5, showing the dispensing well bottom wall, end wall and two mutually opposed openings.

FIG. 13 is a sectional close-up view of the spout area of lid 310, similar to FIG. 6, wherein like reference numerals once again represent like elements. As shown in FIG. 13, the baffle wall 90 connects end wall 54 with outer spout wall 34. Similarly, baffle wall 92 connects end wall 54 with inner spout wall 36. As will be realized, baffle wall 92, end wall 54, and baffle wall 90 collectively serve to block fluid masses coming from behind them from entering the dispensing well. A similar blocking effect is provided by baffle wall 96, end wall 56, and baffle wall 94. Thus, for the most part, only vertically upright splashes will reach the space between baffle walls 92 and 96 and baffle walls 90 and 94.

It will be appreciated that the rest of the splashed fluid mass from the cup that does not enter the space between baffles 92 and 96 and the space between baffles 90 and 94 will hit the interior surfaces of the lid and be directed back into the cup. In addition, a portion of the splashed fluid that is directed between the baffle walls will impinge against the underside of the spout top wall 32, and will also be redirected back into the cup. Thus, only a relatively small portion of the splashed fluid will escape openings 60 and 62.

The effectiveness of the lid according to embodiments of the present invention in reducing the escape of splashed liquid and droplets from the drinking cup was verified by comparing splashing of coffee over prior art lids having an open drink-through opening. Two cups filled with equal amounts of coffee were placed in the cup holders of a car next to each other, wherein one of the cups was equipped with a typical open-spout lid of the prior art, and the other was equipped with a lid constructed according to the embodiment of the invention shown in FIGS. 1 through 9. The car was driven for about fifty minutes so as to simulate a long commute, but the path was chosen to have some speed bumps, pot-holes, and a rail road crossing, and the driving included sudden braking and acceleration.

Beverage loss from the respective cup-lid assemblies was measured by weighing the cups before and after the experiment. The beverage loss from the cup having the open spout prior art lid assembly was about 7 grams, while the beverage loss from the cup having a lid assembly according to the present invention was merely 0.8 grams. Thus, the open spout prior art lid allowed over 8.5 times more beverage splashing than the lid of the present invention. In other words, the loss from splashing allowed by the lid of the present invention was less than 12% of that allowed by the prior art, open spout lid. Thus, the open spout lid exhibited substantial beverage loss due to splashes and spills, and the lid of the present invention offered substantial improvement over the open spout lid in terms of splashing.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

This specification is not intended to be exhaustive. Although the present application is shown in a limited number of forms, the scope of the invention is not limited to just these forms, but is amenable to various changes and modifications without departing from the spirit thereof. One or ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

What is claimed is:

1. A lid for use with a drinking vessel, said lid comprising:

a peripheral rim configured for engaging with said drinking vessel;

a raised drinking spout proximal to said peripheral rim, said drinking spout comprising an outer spout wall extending upwardly from said peripheral rim, an inner spout wall spaced inward from said outer spout wall, and a spout top wall connected to and extending between said outer spout wall and said inner spout wall, said drinking spout being configured for allowing consumption of a beverage contained within an interior of said drinking vessel by a user; and a dispensing well formed within said spout top wall, said dispensing well comprising at least a bottom wall, a first opening proximate said outer spout wall, and a second opening located opposite to said first opening and proximate said inner spout wall, wherein said bottom wall is closed for substantially blocking impinging splashes of a beverage contained in said drinking vessel, while beverage flowing from a splash proximal to the outer or inner spout wall is able to reach one of said first and second openings and pass through the dispensing well to the other of said first and second openings without obstruction.

2. The lid of claim 1, wherein said inner spout wall extend s upwardly from a central portion of the lid.

3. The lid of claim 1, wherein said dispensing well further comprises first and second end walls, and wherein said bottom wall connects said first and second end walls.

4. The lid of claim 1, wherein said bottom wall of said dispensing well is inclined such that when the peripheral rim is horizontal, the bottom wall is not horizontal.

5. The lid of claim 1, further comprising at least one vent hole that provides air communication between the interior of the drinking vessel and air exterior to the lid.

6. The lid of claim 5, wherein a diameter of the vent hole is less than 0.060 inches.

7. The lid of claim 5, wherein a diameter of the vent hole is approximately 0.032 inches.

8. The lid of claim 1, further comprising a plurality of vent holes that admit air into the interior of the drinking vessel as the beverage in the drinking vessel is consumed.

9. The lid of claim 8, wherein at least a first vent hole amongst said plurality of vent holes is located proximate said dispensing well.

10. The lid of claim 8, wherein said plurality of vent holes includes a plurality of vent hole sizes.

11. The lid of claim 1, further comprising a plurality of vent holes located at a plurality of proximities from said dispensing well, wherein at least one vent hole amongst said plurality of vent holes is blocked by said beverage when the drinking vessel is substantially full of beverage and is tipped towards the user for drinking therefrom.

12. The lid of claim 1, wherein at least one surface of the lid includes at least one of a texture and a protruding structure configured to influence a flow of said beverage across said at least one surface.

13. The lid of claim 1, wherein said lid is constructed from at least one of paper, plastic, thermoplastic resin, foam, a laminated material, a compostable resin, and a biodegradable material.

14. The lid of claim 1, wherein said lid is manufactured by one of thermoforming, injection molding, compression molding, vacuum forming, pressure forming, and hydro forming.

15. The lid of claim 1, wherein said lid is injection molded from a suitable grade of polypropylene resin.

16. The lid of claim 1, wherein said lid is injection molded from a plastic material.

17. The lid of claim 1, wherein said lid is disposable.

18. The lid of claim 1, wherein said lid is compatible for use with a drinking vessel that is configured for holding and dispensing a drinkable fluid that is one of tea, coffee, soup, shake, juice, and milk.

19. The lid of claim 1, further comprising at least one interior baffle wall disposed around the dispensing well and configured to inhibit a beverage that is at least one of swirling and laterally-splashing from entering the dispensing well.

20. The lid of claim 19, wherein the at least one interior baffle wall connects end walls of the dispensing well with the outer spout wall and with the inner spout wall.

21. The lid of claim 1, wherein the bottom wall of the dispensing well is substantially horizontal when the peripheral rim is horizontal.

22. The lid of claim 1, wherein at least one of the first and second dispensing well openings is inclined from vertical when the peripheral rim is horizontal by an angle of less than 30 degrees.

23. The lid of claim 1, wherein at least one of the first and second dispensing well openings is inclined from vertical when the peripheral rim is horizontal by an angle of less than 20 degrees.

24. The lid of claim 1, wherein at least one of the first and second dispensing well openings is inclined from vertical when the peripheral rim is horizontal by an angle of less than 10 degrees.

25. The lid of claim 1, wherein the first and second dispensing well openings do not differ from each other in area by more than 30%.

26. The lid of claim 1, wherein the first and second dispensing well openings do not differ from each other in area by more than 15%.

27. The lid of claim 1, wherein a combined area of the first and second dispensing well openings is at least 0.06 $in^2$.

28. The lid of claim 1, wherein a combined area of the first and second dispensing well openings is at least 0.08 $in^2$.

29. The lid of claim 1, wherein a combined area of the first and second dispensing well openings is at least 0.09 $in^2$.

30. The lid of claim 1, wherein a combined area of the first and second dispensing well openings is between 0.08 $in^2$ and 0.2 $in^2$.

31. The lid of claim 1, wherein a combined area of the first and second dispensing well openings is between 0.10 $in^2$ and 0.25 $in^2$.

32. The lid of claim 1, wherein each of the first and second dispensing well openings has an area that is between 0.04 $in^2$ and 0.8 $in^2$.

33. A lid for use with a drinking vessel and for drinking a beverage therethrough, said lid comprising:

a peripheral rim;

a downwardly projecting dispensing well comprising a bottom wall, and first and second openings located opposite to each other, said first opening being proximate to said peripheral rim and said second opening being located opposite to said first opening and being distal to said peripheral rim, wherein said bottom wall is closed for substantially blocking impinging splashes of said beverage while beverage flowing from a splash proximal to the outer or inner spout wall is able to reach one of said first and second openings and pass through the dispensing well to the other of said first and second openings without obstruction, and wherein said first and second openings are configured to allow passage therethrough of said beverage contained in said drinking vessel.

34. The lid of claim 1, wherein at least one of the first and second openings extends to the bottom wall of the dispensing well.

* * * * *